US007083008B2

(12) United States Patent
Thorp et al.

(10) Patent No.: US 7,083,008 B2
(45) Date of Patent: Aug. 1, 2006

(54) APPARATUS AND METHOD FOR PRESSURE-COMPENSATED TELEMETRY AND POWER GENERATION IN A BOREHOLE

(75) Inventors: Richard Thorp, Richmond, TX (US); Raju Eason, Stafford, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 316 days.

(21) Appl. No.: 10/794,726

(22) Filed: Mar. 6, 2004

(65) Prior Publication Data

US 2005/0194186 A1 Sep. 8, 2005

(51) Int. Cl.
*E21B 4/04* (2006.01)
*E21B 17/18* (2006.01)

(52) U.S. Cl. ..... 175/57; 175/107; 175/320

(58) Field of Classification Search ..... 175/107, 175/104, 320, 57, 25; 166/104
See application file for complete search history.

(56) References Cited

U.S. PATENT DOCUMENTS 2,700,131 A * 1/1955 Alder et al. ..... 324/323

(Continued)

FOREIGN PATENT DOCUMENTS

GB 1 364 265 8/1974

(Continued)

OTHER PUBLICATIONS

IMPulse Services, Schlumberger brochure, date unknown.

(Continued)

*Primary Examiner*—Kenneth Thompson

(74) *Attorney, Agent, or Firm*—Jennie Salazar; Victor H. Segura; Dale V. Gaudier

(57) ABSTRACT

An apparatus and related method are useful for compensating the pressure of drilling fluid in a drill collar disposed in a borehole. The apparatus includes a stator adapted for being secured within the drill collar against rotation relative to the drill collar, and a shaft rotatably carried within the stator so as to define a fluid-conducting annular gap between the shaft and the stator. The shaft has a fluid-conducting channel extending axially therethrough. A rotor is secured about the shaft for rotation therewith. A portion of the rotor is disposed adjacent a portion of the stator so as to define an inlet between the rotor and stator portions through which drilling fluid in the drill collar will be conducted. The rotor portion further cooperates with the stator and the shaft to define a first annular cavity that fluidly communicates with the gap and the inlet. A rotary seal is disposed in the first cavity for isolating the gap from the inlet. Either the rotor, the shaft, or a combination thereof, are equipped with a first compensating chamber for holding a compensating fluid. The first compensating chamber fluidly communicates with the gap. A movable barrier is disposed in the first compensating chamber for isolating the compensating fluid. At least one port extends through the rotor for communicating drilling fluid pressure to the compensating fluid via the movable barrier.

21 Claims, 5 Drawing Sheets

U.S. PATENT DOCUMENTS

| | | | | | |
|---|---|---|---|---|---|
| 3,014,542 | A | * | 12/1961 | Hildebrandt et al. | 175/107 |
| 3,309,656 | A | * | 3/1967 | Godbey | 367/85 |
| 4,532,614 | A | | 7/1985 | Peppers | |
| 4,847,815 | A | | 7/1989 | Malone | |
| 4,875,300 | A | | 10/1989 | Kazz | |
| 4,914,637 | A | | 4/1990 | Goodsman | |
| 5,073,877 | A | | 12/1991 | Jeter | |
| 5,237,540 | A | | 8/1993 | Malone | |
| 5,249,161 | A | | 9/1993 | Jones et al. | |
| 5,517,464 | A | | 5/1996 | Lerner et al. | |
| 5,586,083 | A | * | 12/1996 | Chin et al. | 367/84 |
| 5,793,625 | A | | 8/1998 | Balogh | |
| 6,219,301 | B1 | | 4/2001 | Moriarty | |
| 6,257,355 | B1 | | 7/2001 | Baker | |
| 2005/0199423 | A1 | | 9/2005 | Moriarty | |

FOREIGN PATENT DOCUMENTS

| | | |
|---|---|---|
| GB | 2 290 320 | 12/1995 |
| WO | WO 99/19594 | 4/1999 |

OTHER PUBLICATIONS

SlimPulse: Next generation retrievable MWD tool, Schlumberger brochure, Aug. 2002.

* cited by examiner

APPARATUS AND METHOD FOR PRESSURE-COMPENSATED TELEMETRY AND POWER GENERATION IN A BOREHOLE

BACKGROUND OF THE INVENTION

1. Field of the Invention

The present invention relates to downhole tools used in oil and gas drilling operations, and more particularly, to telemetry and power-generating means for measurement-while-drilling (MWD) tools and processes used in such operations.

2. Background of the Related Art

The drilling of oil and gas wells typically involves the use of several different measurement and telemetry systems to provide data regarding the subsurface formation penetrated by a borehole, and data regarding the state of various drilling mechanics during the drilling process. In measurement-while-drilling (MWD) tools, data is acquired by sensors located in the drill string near the bit. This data is either stored in downhole memory or transmitted to the surface using a telemetry means, such as mud flow telemetry devices.

Both the downhole sensors and the telemetry means of the MWD tool require electrical power. Since it is not feasible to run a power supply cable from the surface through the drill string to the sensors or the telemetry means, electrical power must be obtained downhole. The state of the art MWD devices obtain such power downhole either from a battery pack or a turbine-based alternator. Examples of alternators used in downhole tools are shown in U.S. Pat. No. 5,517,464, assigned to the assignee of the present invention, and U.S. Pat. No. 5,793,625 assigned to Baker Hughes.

Turbine-based alternators employ rotors having impellers that are placed in the high-pressure flow of drilling fluid ("mudflow") inside the drill string so that the impeller blades convert the hydraulic energy of the drilling fluid into rotation of the rotor. The rotors rotate at an angular velocity (speed) that provides enough energy to the MWD tools to power the telemetry means (e.g., a modulator) and sensors, and—in some cases—other tools in the drill string bottom-hole assembly (BHA).

In most conventional designs, the rotor of the turbine is coupled to a drive shaft which is coupled to an alternator, either directly or via a gear train that adapts the rotor's rotational speed for optimum operation of the turbine and alternator. The drive shaft is supported by bearings. Typically, the shaft, bearings, gear train, and alternator are all housed in a pressurized oil chamber in order to function in clean and well-lubricated conditions. Since the upstream portion of the drive shaft is rotating in drilling fluid, a rotary seal is required to isolate the drilling fluid from the oil in the pressurized chamber. The face of a typical rotary seal has to be lubricated by something other than the drilling fluid, since the drilling fluid contains erosive particles that will quickly ruin the rotary seal. This lubrication is achieved by ensuring a constant, low-volume oil leak from the pressurized chamber across the rotary seal. This leak also prevents the flowing drilling fluid from invading the oil chamber, which is desirable since the cleanliness of the oil promotes a long operating life for the gears, bearing, and electrical components inside the oil (i.e., drilling fluid particles would erode moving parts and damage the alternator components.) A well-known solution for achieving this controlled leakage of oil across the rotary seal is to employ a compensating piston that is biased by a spring having an appropriate spring constant within the pressurized oil chamber. For drilling efficiency, this piston is required to move a significant distance over time, which makes the spring and the chamber longer and bulkier than they might otherwise have to be. Accordingly, the compensating piston/spring assembly tends to make the downhole provision of power expensive. Furthermore, experience in the art has proven that a significant percentage of the failures and maintenance costs associated with downhole alternators are due to the extended length of the piston/spring oil reservoir pressure-compensation system. Still further, such a piston/spring configuration is, in many applications, an inefficient method of providing the necessary pressure rise needed to match the mud pressure. This is particularly true in tool configurations wherein the rotary seal is exposed to high hydrostatic-pressure drilling fluid (i.e., mud introduced at an upstream location), and the oil pressure must be raised to a magnitude several hundred pounds per square-inch (psi) above the local downstream mud pressure.

A need therefore exists for a pressure compensation that is not burdened by such shortcomings.

DEFINITIONS

Certain terms are defined throughout this description as they are first used, while certain other terms used in this description are defined below:

"Downstream" means the direction in which drilling fluid is pumped to flow through a drill string, e.g., in the direction of the gravity vector in a vertical well section.

"Particles" means relatively heavy solids, some of which are designed to plug small holes, that are mixed or suspended in a drilling fluid. Particles can exhibit a wide range of sizes, and can include cuttings resulting from the drilling process as well as additives that are used to control the hydrostatic conditions of the borehole.

"Upstream" means the direction opposite to downstream.

SUMMARY OF THE INVENTION

In one aspect, the present invention provides an apparatus for compensating the hydrostatic pressure (also referred to herein simply as "pressure") of drilling fluid in a drill collar disposed in a borehole. The apparatus includes a stator adapted for being secured within the drill collar against rotation relative to the drill collar, and a shaft rotatably carried within the stator so as to define a fluid-conducting annular gap between the shaft and the stator. The shaft has a fluid-conducting channel extending axially therethrough. A rotor is secured about the shaft for rotation therewith. A portion of the rotor is disposed adjacent a portion of the stator so as to define an inlet between the rotor and stator portions through which (a portion of the) drilling fluid in the drill collar will be conducted. The rotor portion further cooperates with the stator and the shaft to define a first annular cavity that fluidly communicates with the gap and the inlet. A rotary seal is disposed in the first cavity for isolating the gap from the inlet. Either the rotor, the shaft, or a combination thereof, is equipped with a first compensating chamber for holding a compensating fluid. The first compensating chamber fluidly communicates with the gap. A movable barrier is disposed in the first compensating chamber for isolating the compensating fluid. At least one port extends through the rotor for communicating drilling fluid pressure to the compensating fluid via the movable barrier.

Accordingly, a portion of the drilling fluid flowing through the drill collar when the stator is secured therein is conducted through the inlet to apply a first nominal pressure against the rotary seal. A portion of the flowing drilling fluid is further conducted through the port to apply a nominal pressure against the movable barrier that urges compensating fluid in the first compensating chamber to be conducted through the gap so as to apply a second nominal pressure against the rotary seal opposing the first nominal pressure. The second nominal pressure is at least as great as the first nominal pressure so as to compensate the pressure of drilling fluid in the inlet and prevent drilling fluid from entering the gap. Such compensation is preferably achieved by positioning the port upstream of the inlet, so as to ensure that drilling fluid conducted through the port has a greater nominal pressure than the drilling fluid conducted through the inlet.

In a particular embodiment, the rotary seal employs a ceramic face seal.

In a particular embodiment, the shaft of the inventive apparatus is equipped with an expanded tubular housing that defines the first compensating chamber. In this embodiment, the movable barrier includes a piston disposed for sliding axial movement within the first compensating chamber. The piston divides the first compensating chamber into upstream and downstream portions. The upstream first compensating chamber portion fluidly communicates with the port via the channel for receiving drilling fluid pressure, while the downstream first compensating chamber portion holds the compensating fluid and fluidly communicates with the gap. The piston preferably includes a check valve for relieving excess pressure in the downstream first compensating chamber portion that may result due to thermal expansion of the compensating fluid. This embodiment is also adaptable to use a bladder or a bellows, in place of the piston, as the movable barrier.

In another embodiment of the inventive apparatus, the rotor is equipped with a spear point body for raising and lowering the apparatus within a drill collar. In this embodiment, the first compensating chamber is defined by a second cavity formed within the spear point body, and the movable barrier preferably includes a bladder disposed for contraction and expansion within the first compensating chamber. The bladder divides the first compensating chamber into inner and outer portions. The outer first compensating chamber portion is outside the bladder and fluidly communicates with the port for receiving drilling fluid pressure, while the inner first compensating chamber portion is inside the bladder and holds the compensating fluid. The inner first compensating chamber portion fluidly communicates with the gap via the channel.

Further in this embodiment, the stator is preferably equipped with a downstream tubular housing that defines an second pressure compensating chamber about a downstream portion of the shaft. The movable barrier preferably includes a piston disposed for sliding axial movement within the second compensating chamber. The piston divides the second compensating chamber into upstream and downstream portions. The upstream second compensating chamber portion contains the compensating fluid and a spring biased to urge the piston upstream through the second compensating chamber. The upstream second compensating chamber portion fluidly communicates with the inner first compensating chamber portion via the channel for replenishing the compensating fluid volume within the inner first compensating chamber portion. The downstream second compensating chamber portion fluidly communicates with at least one port extending through the stator housing for conducting drilling fluid into the downstream second compensating chamber portion.

The inventive apparatus preferably further includes a compressible element disposed in the first compensating chamber for reducing the risk of damage to the apparatus should the apparatus be subjected to freezing temperatures. The compressible element is, in one embodiment, a metal bellows that is partially filled with a fluid for preventing over-pressuring of the compressible element.

In another aspect, the present invention provides a method for compensating the pressure of drilling fluid in a drill collar disposed in a borehole. The method includes the steps of securing a stator against rotation within the drill collar, and rotatably-supporting a shaft within the stator so as to define a fluid-conducting annular gap between the shaft and the stator. A rotor is secured about the shaft for rotation therewith. A portion of the rotor is disposed adjacent a portion of the stator so as to define an inlet therebetween through which drilling fluid in the drill collar will be conducted. The rotor portion cooperates with the stator portion and the shaft to define a first annular cavity in fluid communication with the gap and the inlet. A rotary seal is disposed in the first cavity so as to isolate the gap from the inlet. A volume of compensating fluid is isolated within either the rotor, the shaft, or a combination thereof, using a movable barrier. When drilling fluid flows through the drill collar, a portion of the flowing drilling fluid pressure is conducted though the rotor to the movable barrier so as to pressurize the compensating fluid to a nominal pressure at least as great as the nominal pressure on the inlet side of the seal resulting from the drilling fluid at the inlet. The pressurized compensating fluid is delivered to the gap side of the seal to compensate the pressurized drilling fluid at the inlet. Such compensation is preferably achieved by conducting the drilling fluid portion through the rotor via a port in the rotor positioned upstream of the inlet, thereby ensuring that the drilling fluid conducted through the port has a greater nominal pressure than the drilling fluid conducted through the inlet.

The inventive method preferably further includes the step of relieving excess pressure in the isolated compensating fluid that may occur due to thermal expansion.

In a particular embodiment, the compensating fluid is isolated by the movable barrier within the shaft. Here, the movable barrier includes one of a piston, a bladder, and a bellows disposed for movement within a portion of the shaft so as to pressurize the compensating fluid.

In a further embodiment, the compensating fluid is isolated by the movable barrier within the rotor. Here, wherein the movable barrier includes a bladder or a bellows disposed for movement within a portion of the rotor so as to pressurize the compensating fluid. This embodiment preferably further includes the steps of isolating a second volume of compensating fluid within the shaft using a movable barrier, and replenishing the first volume of compensating fluid with compensating fluid from the second volume when drilling fluid stops flowing through the drill collar.

BRIEF DESCRIPTION OF THE DRAWINGS

So that the above recited features and advantages of the present invention can be understood in detail, a more particular description of the invention, briefly summarized above, may be had by reference to the embodiments thereof that are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION OF THE INVENTION

Figure 1:
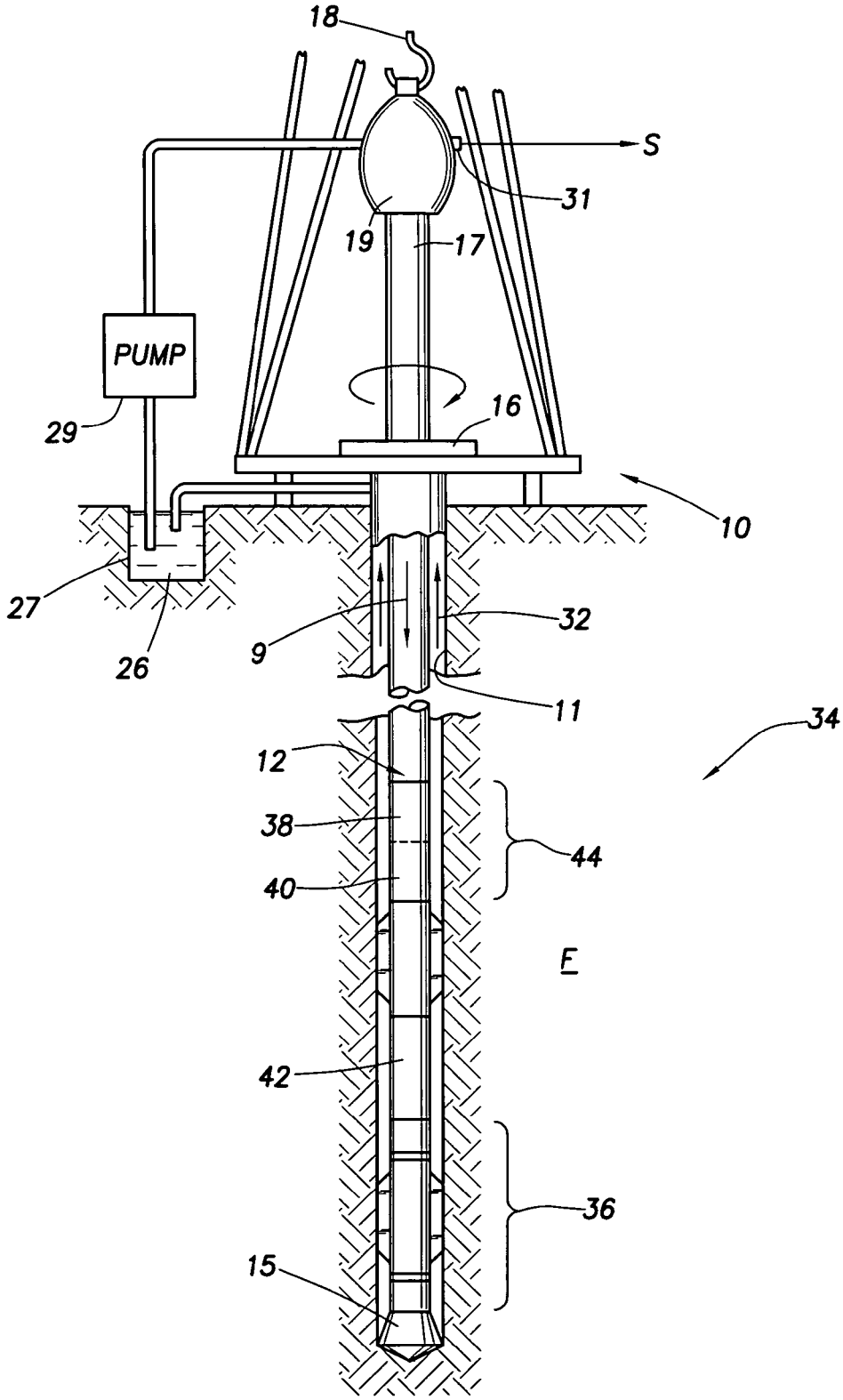
FIG. 1 is an elevational representation of a conventional rotary drilling string in which the present invention may be employed to advantage.

FIG. 1 illustrates a convention drilling rig and drill string in which the present invention can be utilized to advantage. A land-based platform and derrick assembly 10 are positioned over a borehole 11 penetrating a subsurface formation F. In the illustrated embodiment, the borehole 11 is formed by rotary drilling in a manner that is well known. Those of ordinary skill in the art given the benefit of this disclosure will appreciate, however, that the present invention also finds application in drilling applications other than conventional rotary drilling (e.g., mud-motor based directional drilling), and is not limited to land-based rigs.

A drill string 12 is suspended within the borehole 11 and includes a drill bit 15 at its lower end. The drill string 12 is rotated by a rotary table 16, energized by means not shown, which engages a kelly 17 at the upper end of the drill string. The drill string 12 is suspended from a hook 18, attached to a traveling block (also not shown), through the kelly 17 and a rotary swivel 19 which permits rotation of the drill string relative to the hook.

Drilling fluid, or mud, 26 is stored in a pit 27 formed at the well site. A pump 29 delivers the drilling fluid 26 to the interior of the drill string 12 via a port in the swivel 19, inducing the drilling fluid to flow downwardly through the drill string 12 as indicated by the directional arrow 9. The drilling fluid exits the drill string 12 via ports in the drill bit 15, and then circulates upwardly through the region between the outside of the drill string and the wall of the borehole, called the annulus, as indicated by the directional arrows 32. In this manner, the drilling fluid lubricates the drill bit 15 and carries formation cuttings up to the surface as it is returned to the pit 27 for recirculation.

The drill string 12 further includes a bottom hole assembly (BHA), generally referred to as 34, near the drill bit 15 (in other words, within several drill collar lengths from the drill bit). The bottom hole assembly includes capabilities for measuring, processing, and storing information, as well as communicating with the surface. The BHA 34 thus includes, among other things, an apparatus 36 for determining and communicating one or more properties of the formation F surrounding borehole 11, such as formation resistivity (or conductivity), natural radiation, density (gamma ray or neutron), and pore pressure.

The BHA 34 further includes drill collars 42, 44 for performing various other measurement functions. Drill collar 44, in particular, houses a measurement-while-drilling (MWD) tool. The MWD tool includes a telemetry and power subassembly 38 that communicates with a similar system (not shown) at the earth's surface. In addition to providing power for telemetry means (described further below), the subassembly 38 communicates data/commands with, and provides power for, a sensor package 40 within the MWD tool. The sensor package 40 includes appropriate instrumentation for determining real-time drilling parameters such as direction, inclination, and toolface, among other things.

Figure 2:
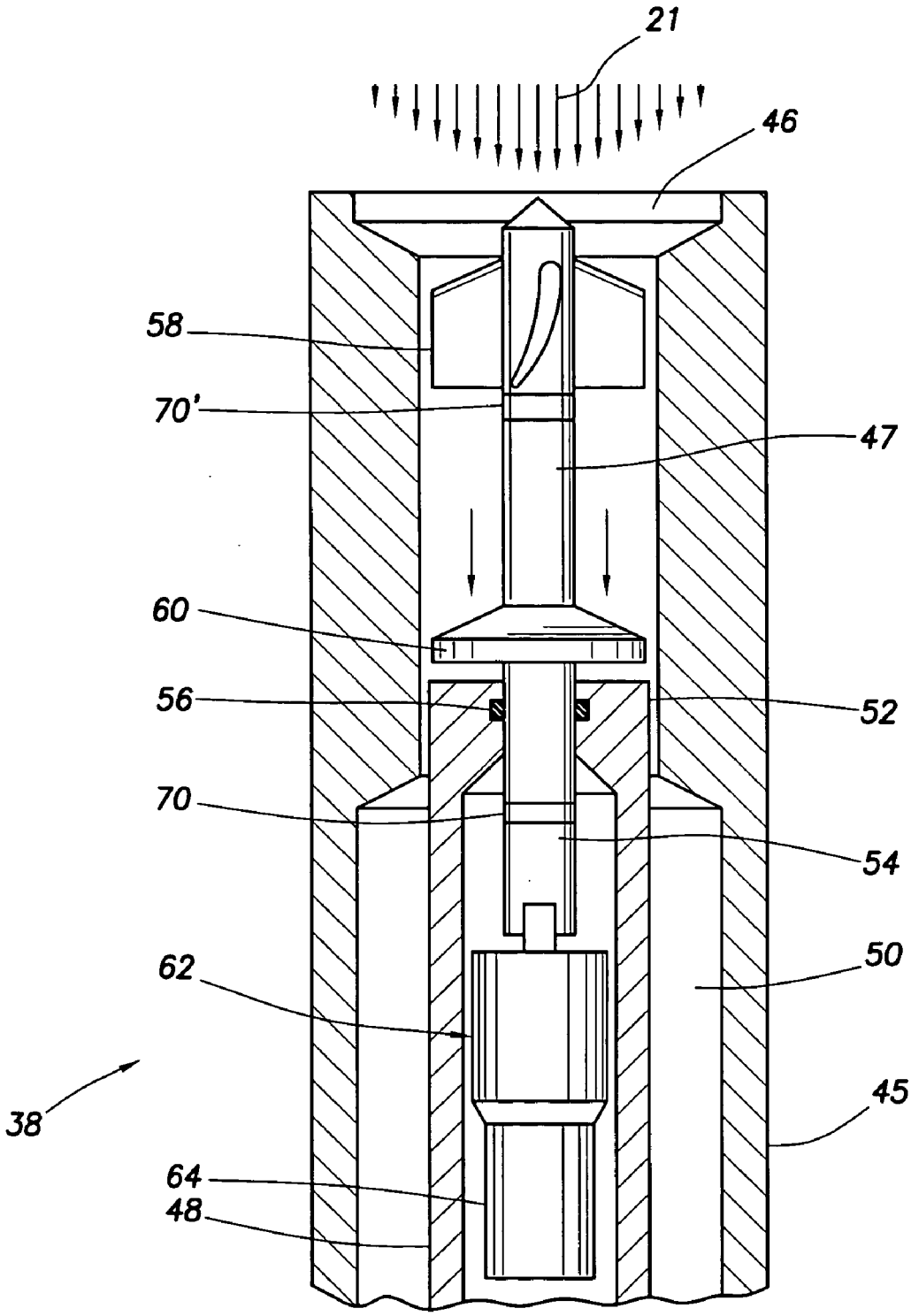
FIG. 2 is simplified schematic of a telemetry and power subsystem of a MWD tool in accordance with the present invention.

The telemetry and power subassembly 38, also generally known as a modulator and turbine generator, is illustrated schematically in FIG. 2. The subassembly 38 includes a sleeve 45 secured within the drill collar 44 (not shown in FIG. 2). The sleeve 45 has an upper open end 46 into which the drilling fluid, or mud, flows in a downward direction as indicated by the downward arrow velocity profile 21. A stator 48, which also generally serves as a tool housing, is secured against rotation relative to the drill collar 44 by being mounted within the flow sleeve 44, thereby creating an annular passage 50. The upper end of the stator 48 carries modulator stator blades 52.

A rotor 47 and drive shaft 54, which are secured concentrically for common rotation, are centrally mounted in the upstream end of the stator 48 by a rotary sealing/bearing assembly 56. The rotor 47 is disposed upstream of the stator 48, while the drive shaft 54 extends both upwardly out of the stator 48 and downwardly into the stator 48. A turbine impeller 58 is mounted at the upper end of the rotor 47 just downstream from the upper open end 46 of the sleeve 45. A modulator rotor 60 is mounted on the rotor 47 downstream of the turbine impeller 58 and immediately upstream of the modulator stator blades 52. The modulator rotor and stator cooperate to generate a pressure pulse-signal—having an amplitude exceeding several hundred pounds per square-inch (psi)—which is representative of the measured drilling parameters. The generated signal is received at the surface by transducers, represented by reference numeral 31 (see FIG. 1), that convert the received acoustical signals to electronic signals S for further processing, storage, and use according to conventional methods and systems. The lower end of the drive shaft 54 is coupled to a gear train 62 which is mounted within the stator 48 and which, in turn, is coupled to an alternator 64. The alternator 64 is mounted in the stator 48 downstream of the gear train 62.

The present invention is directed to the compensation, or balancing, of the drilling fluid pressure within a drill collar (or more specifically, within sleeve 45) by compensating fluid (generally oil) carried within the tool. Such pressure compensation is important for preventing the ingress of drilling fluid past the rotary bearing/seal assembly 56. As mentioned above, a modulator can generate pressure pulses exceeding several hundred pounds per square-inch (psi). Such pulses can only be compensated by raising the pressure of the compensating oil behind the rotary seal above this level. Accordingly, the present invention is embodied in a plurality of apparatuses and methods for compensating the pressure of drilling fluid in a drill collar disposed in a borehole. FIG. 2 schematically illustrates a pressure compensating chamber 70 disposed within the drive shaft 54, as well as an alternative pressure compensating chamber 70', which may be employed by the present invention.

Figure 3A:
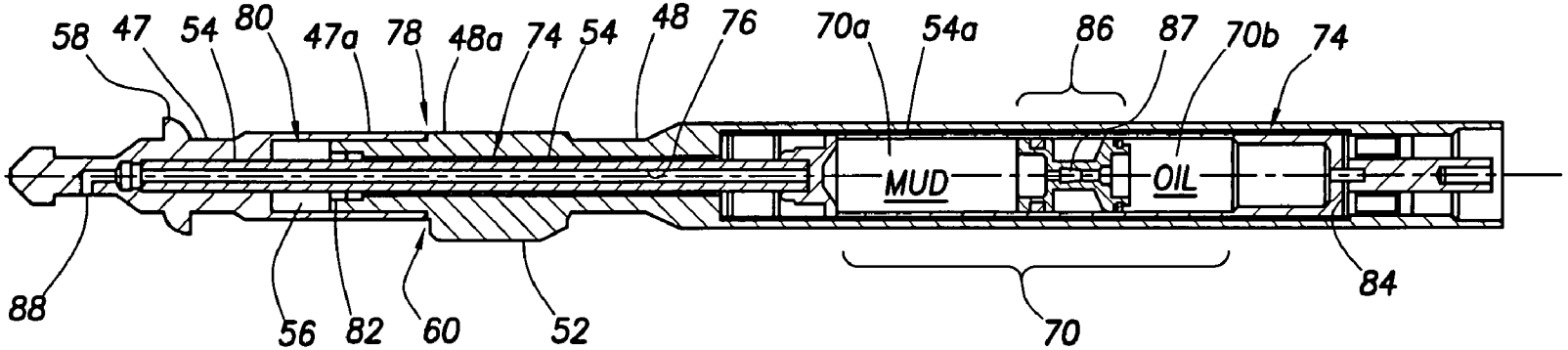
FIG. 3A is a detailed sectional schematic of an apparatus for compensating the pressure of drilling fluid acting upon a rotary seal, in accordance with the present invention.
Figure 3B:
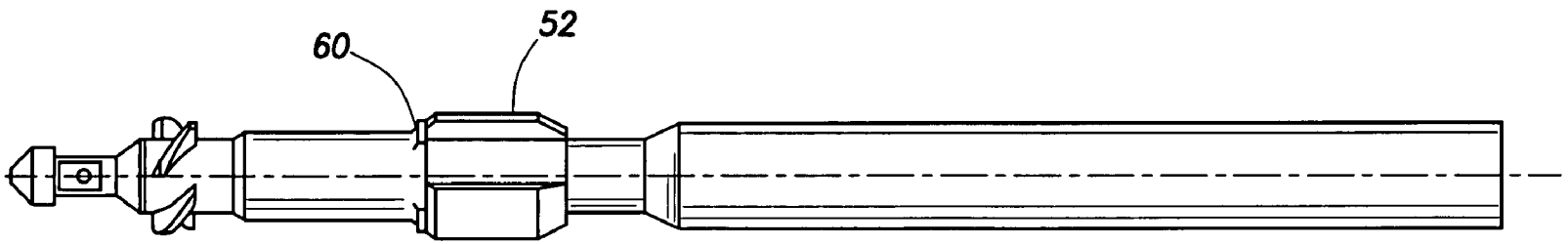
FIG. 3B shows the exterior of the apparatus of FIG. 3A.
Figure 3C:
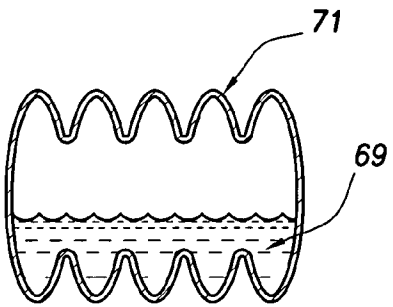
FIG. 3C is a detailed sectional view of a metal bellows having utility in the apparatus of FIGS. 3A–3B.

Turning now to FIGS. 3A–3C, an exemplary embodiment of the inventive apparatus is shown to include a tubular stator 48 adapted for being secured within the drill collar 44 via sleeve 45 (neither of which are shown in FIGS. 3A–3C) against rotation relative to the drill collar. A drive shaft 54 is rotatably carried within the stator 48 so as to define a fluid-conducting annular gap 74 between the drive shaft 54 and the stator 48. The drive shaft 54 has a fluid-conducting channel 76 extending axially therethrough, for fulfilling a purpose that will be described below.

A tubular rotor 47 is secured concentrically about the drive shaft 54 for rotation therewith. A portion 47*a* of the rotor near the modulator rotor 60 (see FIG. 3B) is disposed adjacent a portion 48*a* of the stator near the modulator stator blades 52 so as to define an inlet 78 through which drilling fluid (see reference 21 in FIG. 2) in the sleeve 45 within the drill collar 44 will be conducted. The rotor portion 47*a* further cooperates with the stator and the drive shaft to define a first annular cavity 80 that fluidly communicates with the gap 74 and the inlet 78. A rotary seal assembly 56 employing a ceramic face seal is disposed in the first cavity 80 for isolating the gap 74 from the inlet 78. A rotary bearing assembly 82 is carried by the stator 48 adjacent the rotary seal 56.

The drive shaft 54 is equipped with an expanded tubular housing 54*a* that defines a first compensating chamber 70 for holding a compensating fluid, preferably an oil that is suitable for the drilling environment. The first compensating chamber 70 fluidly communicates with the gap 74 via a downstream port 84. A movable barrier, in the form of a piston 86, is disposed in the first compensating chamber 70 for isolating the compensating fluid. The piston 86 is disposed for sliding axial movement within the first compensating chamber 70, and divides the first compensating chamber into upstream and downstream portions 70*a*, 70*b*. The upstream first compensating chamber portion 70*a* fluidly communicates with a port 88 in the rotor 47 via the drive shaft channel 76 for receiving drilling fluid (labeled "MUD" in chamber portion 70*a*) flowing though the drill collar. The downstream first compensating chamber portion 70*b* holds the compensating fluid (labeled "OIL" in chamber portion 70*b*) and fluidly communicates with the gap 74 via the port 84.

The piston 86 includes a check valve 87 for relieving excess pressure in the downstream first compensating chamber portion 70*b* that may result due to thermal expansion of the compensating fluid. This allows the apparatus to be completely filled with oil, because thermal expansion will be compensated by bleeding of the compensation oil across the check valve.

This embodiment of the present invention is also adaptable to use a flexible (i.e., elastomeric, polymeric, or metallic) bladder or bellows as the movable barrier. In these cases, the bladder or bellows would receive the pressure of the drilling fluid conducted through the drive shaft channel 76, and would effectively serve the functions of the upstream first compensating chamber portion 70*a* and the piston 86. An elastomeric bladder, e.g., has particular advantages: it offers no frictional losses, and in the event of mud particles forming clumps, it will merely conform around the obstructions. Additionally, it is less likely that mud particles will stick to a flexible elastomer. In its simplest form, the movable barrier is simply an isolation device, with little or no pressure gradient across it so as to permit the use of low-strength materials. Rubber is a suitable choice, but less flexible polymers may be better. PTFE-based bladders are also desirable because of the chemical inertness, and, similarly, metalized polyesters may be appropriate (e.g., "chip packets"). As mentioned above, should a bladder be used, it is desirable that the compensating oil be on the outside of the bladder, with the drilling fluid on the inside.

Accordingly, when drilling fluid is flowed through the sleeve 45 within the drill collar 44, a portion of the flowing drilling fluid pressure is conducted through the inlet 78 to apply a first nominal pressure against the rotary seal 56. A portion of the flowing drilling fluid pressure is further conducted through the port 88 to apply a pressure against the piston 86 that urges compensating fluid in the downstream first compensating chamber portion 70*b* to be conducted through the gap 74 so as to apply a second nominal pressure against the rotary seal 56 opposing the first nominal pressure. The second nominal pressure is greater than the first nominal pressure so as to compensate the pressure of drilling fluid in the inlet 78 and prevent drilling fluid from crossing the rotary seal 56 and entering the gap 74. Such compensation is achieved by positioning the port 88 upstream of the inlet 78, so as to ensure that drilling fluid conducted through the port 88 has a greater nominal pressure than the drilling fluid conducted through the inlet 78.

Those skilled in the art will therefore appreciate that the location of the port (or ports) may be moved downstream somewhat from the port location referenced at 88, such as in the vicinity of the rotary seal 56, while preserving the desired pressure compensation effect. The port located at reference 88 which will raise the compensating oil to a pressure significantly above the mud pressure at the rotary seal 56. Alternatively, locating the port at a position local to the rotary seal will have the effect of evenly balancing the compensating oil and mud pressures on either side of the rotary seal 56. Should this alternative port site be used, there may be an advantage in using a spring or other stored energy device with which to apply a slight positive oil pressure (relative to the mud pressure) to the seal.

One possible shortcoming with the inventive design is the possibility that the mud freezes in the compensation chamber, and the ensuing expansion damages the apparatus. This risk is mitigated by inserting a compressible element in the first compensating chamber 70 (either on the oil or mud side). With reference to FIG. 3C, the compressible element may be a metal bellows 71 that is partially filled with a fluid 69, such as a suitable oil, for preventing over-pressuring of the compressible element.

Figure 4A:
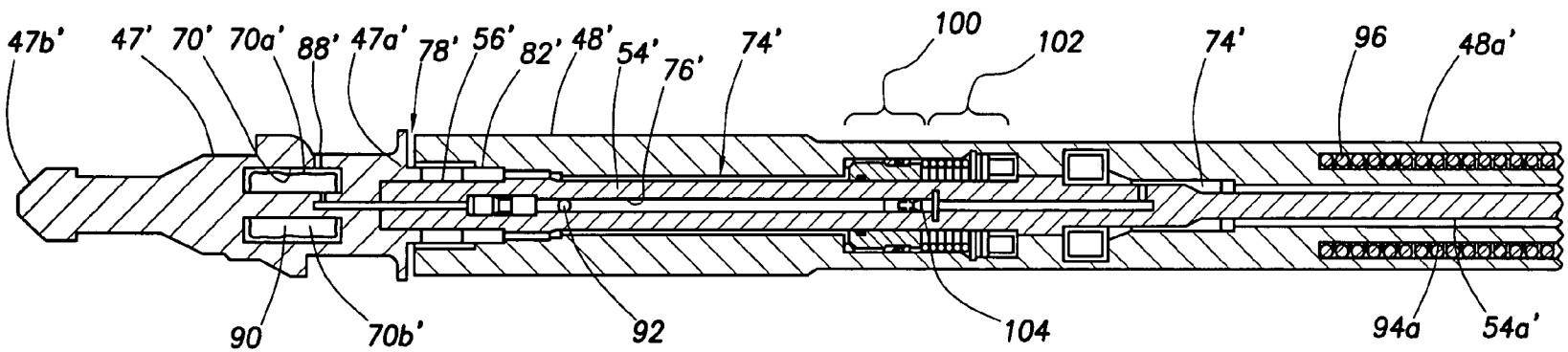
FIGS. 4A–4B are broken sectional views of an alternative apparatus for compensating the pressure of drilling fluid acting upon a rotary seal, in accordance with the present invention.
Figure 4B:
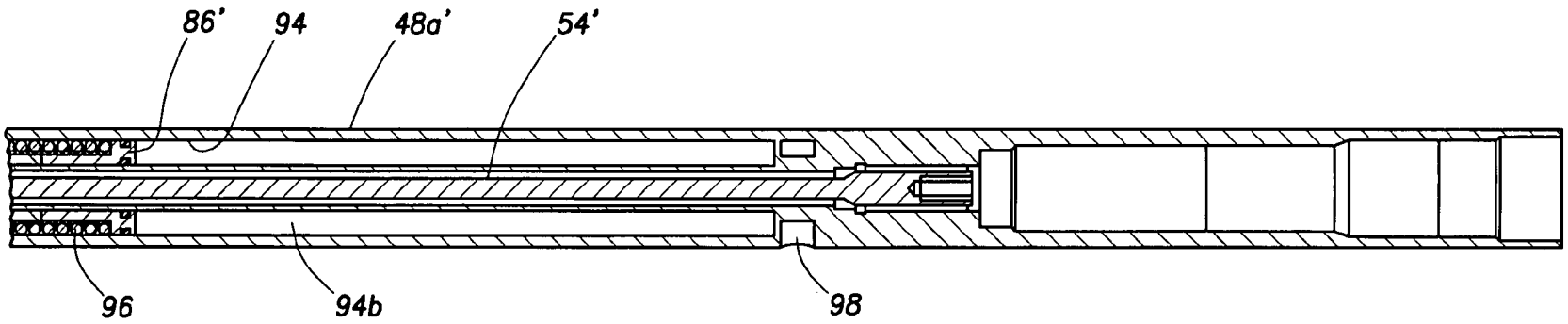

FIGS. 4 A–4B depict another embodiment of the inventive apparatus, using similar reference numbers for similar components to those depicted for the embodiment of FIGS. 3 A–3D. In this embodiment, the first compensating chamber is defined by a second cavity such as the annular cavity 70' formed within the spear point body 47*b*' of the rotor 47'. Given its location, the volume of this cavity is relatively small, such as, e.g., approximately 10–15 cc of capacity available. Preliminary testing indicates that an average oil-leakage rate of 0.1 cc./hr is achievable by the inventive apparatus, which would represent 100–150 hours of drilling (i.e., mud pumps on).

Thermal compensation of the second annular cavity 70' can be achieved by pressure-relieving means carried within the stator 48' or the rotor 47', such as an isolating seal 100 disposed in an enlarged section of the gap 74' to float against an adjacent spring 102, or—alternatively—by equipping the rotor 47' with a relief valve, such as a check valve (not shown), in fluid communication with the second annular cavity 70', permitting upstream venting. Those skilled in the art will appreciate, however, that the seal 100 and spring 102 may be effectively replaced with a suitable metal bellows (not shown).

The movable barrier of this embodiment includes a flexible (i.e., elastomeric, polymeric, or metallic) bladder 90 disposed for contraction and expansion within the first compensating chamber. The bladder 90 divides the first compensating chamber into inner and outer portions. The outer first compensating chamber portion 70*a*' is outside the bladder 90 and fluidly communicates with the port 88' for receiving drilling fluid pressure. The inner first compensating chamber portion 70*b*' is inside the bladder 90 and holds the compensating fluid. The inner first compensating chamber portion fluidly communicating with the gap 74' via the channel 76' and a second port 92 in the drive shaft 54'.

The stator 48' of this embodiment is equipped with a downstream tubular housing 48*a*' that defines a second pressure compensating chamber such as the annular chamber 94 about a downstream portion 54*a*' of the drive shaft 54'. The movable barrier associated with chamber 94 preferably includes an annular piston 86' disposed for sliding axial movement within the second compensating chamber 94. The piston 86' divides the second compensating chamber 94 into upstream and downstream portions 94*a*, 94*b*. The upstream second compensating chamber portion 94*a* contains the compensating fluid and an elongated spring 96. The spring is secured at one of its ends to the piston 86', and is initially loaded in tension by the (preload) pressure of the compensating fluid acting against the piston. In this manner, the spring 96 is biased to urge the piston 86' upstream through the second compensating chamber 94.

A reverse-biased check valve 104 is disposed in the drive shaft channel 76' intermediate the first compensating chamber 70' and the second compensating chamber 94 to isolate the pressure of the compensating fluid within the channel 76' downstream of the check valve 104 when high pressure drilling fluid acts upon the bladder 90 (i.e., when the mud pump 29 is activated). When the mud pump 29 is deactivated, e.g., during a drill string connection at the surface, the pressure differential between the compensating fluid in the channel 76' downstream of the check valve 104 and the compensating fluid in the channel 76' upstream of the check valve 104 is small and the check valve is not biased to a closed position. When this occurs, the energy of the spring 94*a* urges the piston 86' upstream so as to force compensation fluid through the unbiased check valve 104. In this manner, the upstream second compensating chamber portion 94*a* fluidly communicates with the inner first compensating chamber portion via the channel 76' for replenishing the compensating fluid volume within the inner first compensating chamber portion 70*b*' as it is expended by leakage across the rotary seal 56'. The downstream second compensating chamber portion 94*b* fluidly communicates with at least one port 98 extending through the stator housing 48*a*' for conducting drilling fluid into the downstream second compensating chamber portion to compensate for movement upstream by the piston 86'.

It will be understood from the foregoing description that various modifications and changes may be made in the preferred and alternative embodiments of the present invention without departing from its true spirit.

This description is intended for purposes of illustration only and should not be construed in a limiting sense. The scope of this invention should be determined only by the language of the claims that follow. The term "comprising" within the claims is intended to mean "including at least" such that the recited listing of elements in a claim are an open group. "A," "an" and other singular terms are intended to include the plural forms thereof unless specifically excluded.

What is claimed is:

1. An apparatus for pressure-compensated telemetry and power generation in a borehole, the apparatus comprising:

a stator adapted for being secured within the drill collar against rotation relative to the drill collar;

a shaft rotatably carried within the stator so as to define a fluid-conducting annular gap between the shaft and the stator, the shaft having a fluid-conducting channel extending axially therethrough;

a rotor secured about the shaft for rotation therewith, a portion of the rotor being disposed adjacent a portion of the stator so as to define an inlet therebetween through which drilling fluid in the drill collar is conducted, the rotor portion cooperating with the stator and the shaft to define a first annular cavity that fluidly communicates with the gap and the inlet;

a rotary seal disposed in the first cavity for isolating the gap from the inlet;

a first compensating chamber within one of the rotor, the shaft, and a combination thereof, for holding a compensating fluid, the first compensating chamber fluidly communicating with the gap;

a movable barrier disposed in the first compensating chamber for isolating the compensating fluid; and at least one port extending through the rotor for communicating drilling fluid pressure to the compensating fluid via the movable barrier, the port being positioned at a location not downstream of the inlet, such that the drilling fluid conducted through the port has a nominal pressure at least as great as the nominal pressure of the drilling fluid conducted through the inlet.

2. The apparatus of claim 1, wherein the shaft is equipped with an expanded tubular housing that defines the first compensating chamber.

3. The apparatus of claim 2, wherein the movable barrier comprises a piston disposed for sliding axial movement within the first compensating chamber, the piston dividing the first compensating chamber into upstream and downstream portions, the upstream first compensating chamber portion fluidly communicating with the port via the channel for receiving drilling fluid pressure and the downstream first compensating chamber portion holding the compensating fluid and fluidly communicating with the gap.

4. The apparatus of claim 1, wherein the rotor is equipped with a spear point body for raising and lowering the apparatus within a drill collar.

5. The apparatus of claim 4, wherein the first compensating chamber is defined by a second cavity formed within the spear point body.

6. The apparatus of claim 5, wherein the movable barrier comprises one of a bladder and a bellows disposed for contraction and expansion within the first compensating chamber, the bladder dividing the first compensating chamber into inner and outer portions, the outer first compensating chamber portion being outside the bladder and fluidly communicating with the port for receiving drilling fluid pressure and the inner first compensating chamber portion being inside the bladder and holding the compensating fluid, the inner first compensating chamber portion fluidly communicating with the gap via the channel.

7. The apparatus of claim 1, further comprising a compressible element disposed in the first compensating chamber for reducing the risk of damage to the apparatus should the apparatus be subjected to freezing temperatures.

8. The apparatus of claim 7, wherein the compressible element is a metal bellows that is partially filled with a fluid for preventing damage to the compressible element.

9. The apparatus of claim 3, wherein the piston comprises a check valve for relieving excess pressure in the downstream first compensating chamber portion due to thermal expansion of the compensating fluid.

10. The apparatus of claim 6, wherein the stator is equipped with a downstream tubular housing that defines a second pressure compensating chamber about a downstream portion of the shaft, and the movable barrier comprises a piston disposed for sliding axial movement within the second compensating chamber, the piston dividing the second compensating chamber into upstream and downstream portions, the upstream second compensating chamber portion containing the compensating fluid and a spring biased to urge the piston upstream through the second compensating chamber, the upstream second compensating chamber portion fluidly communicating with the inner first compensating chamber portion via the channel for replenishing the compensating fluid volume within the inner first compensating chamber portion, the downstream second compensating chamber portion fluidly communicating with at least one port extending through the stator housing for conducting drilling fluid pressure into the downstream second compensating chamber portion, the apparatus further comprising a check valve disposed in the channel intermediate the inner first compensating chamber portion and the upstream second compensating chamber portion to isolate the pressure of the compensating fluid within the channel upstream of the check valve 104 when high pressure drilling fluid acts upon the movable barrier.

11. The apparatus of claim 6, further comprising a means carried within one of the rotor and the stator for relieving pressure in the compensating that results from thermal expansion.

12. The apparatus of claim 11, wherein the pressure-relieving means comprises one of a biased seal assembly carried by the stator within the gap, a metal bellows carried by the stator within the gap, and a relief valve carried within the rotor so as to vent pressure from the first compensating chamber.

13. A method for compensating the pressure of drilling fluid in a telemetry and power-generating apparatus secured in a drill collar disposed in a borehole, the method comprising the steps of:

securing a stator against rotation within the drill collar;

rotatably-supporting a shaft within the stator so as to define a fluid-conducting annular gap between the shaft and the stator;

securing a rotor about the shaft for rotation therewith, such that a portion of the rotor is disposed adjacent a portion of the stator so as to define an inlet therebetween through which drilling fluid in the drill collar will be conducted, the rotor portion cooperating with the stator and the shaft to define a first annular cavity in fluid communication with the gap and the inlet;

disposing a rotary seal in the first cavity so as to isolate the gap from the inlet;

isolating a volume of compensating fluid within one of the rotor, the shaft, and a combination thereof, using a movable barrier;

when drilling fluid flows through the drill collar, conducting a portion of the flowing drilling fluid pressure though the rotor to pressurize the isolated compensating fluid to a nominal pressure at least as great as the nominal pressure on the inlet side of the seal resulting from the drilling fluid at the inlet;

delivering the pressurized compensating fluid to the gap side of the seal to compensate the drilling fluid pressure at the inlet.

14. The method of claim 13, wherein the drilling fluid pressure portion is conducted through the rotor via a port in the rotor positioned upstream of the inlet, and the drilling fluid conducted through the port has a greater nominal pressure than the drilling fluid conducted through the inlet.

15. The method of claim 13, further comprising the step of relieving excess pressure in the isolated compensating fluid due to thermal expansion.

16. The method of claim 13, wherein the compensating fluid is isolated by the movable barrier within the shaft.

17. The method of claim 16, wherein the movable barrier comprises one of a piston, a bladder, and a bellows disposed for movement within a portion of the shaft so as to pressurize the compensating fluid.

18. The method of claim 13, wherein the compensating fluid is isolated by the movable barrier within the rotor.

19. The method of claim 18, wherein the movable barrier comprises a bladder or a bellows disposed for movement within a portion of the rotor so as to pressurize the compensating fluid.

20. The method of claim 19, further comprising the steps of isolating a second volume of compensating fluid within the shaft using a movable barrier; and replenishing the first volume of compensating fluid with compensating fluid from the second volume when drilling fluid stops flowing through the drill collar.

21. An apparatus for pressure-compensated telemetry and power generation in a borehole, the apparatus comprising:

a stator adapted for being secured within the drill collar against rotation relative to the drill collar;

a shaft rotatably carried within the stator so as to define a fluid-conducting annular gap between the shaft and the stator, the shaft having a fluid-conducting channel extending axially therethrough;

a rotor secured about the shaft for rotation therewith, a portion of the rotor being disposed adjacent a portion of the stator so as to define an inlet therebetween through which drilling fluid in the drill collar is conducted, the rotor portion cooperating with the stator and the shaft to define a first annular cavity that fluidly communicates with the gap and the inlet;

a rotary seal disposed in the first cavity for isolating the gap from the inlet;

a first compensating chamber within an upstream portion of the rotor for holding a compensating fluid, the first compensating chamber fluidly communicating with the gap;

a movable barrier disposed in the first compensating chamber for isolating the compensating fluid; and at least one port extending through the rotor for communicating drilling fluid pressure to the compensating fluid via the movable barrier, the port being positioned at a location not downstream of the inlet, such that the drilling fluid conducted through the port has a nominal pressure at least as great as the nominal pressure of the drilling fluid conducted through the inlet.

* * * * *